United States Patent [19]

Henych et al.

[11] Patent Number: 4,943,411

[45] Date of Patent: Jul. 24, 1990

[54] PROCESS FOR TREATING MOLTEN IRON WITH MAGNESIUM ADDITIONS

[75] Inventors: Ivo Henych, Stetten; Rudolf Pavlovsky, Schaffhausen, both of Switzerland

[73] Assignee: Georg Fischer AG, Schaffhausen, Switzerland

[21] Appl. No.: 430,803

[22] Filed: Nov. 2, 1989

Related U.S. Application Data

[63] Continuation-in-part of Ser. No. 349,642, May 10, 1989, Pat. No. 4,897,242.

[30] Foreign Application Priority Data

Nov. 4, 1988 [CH] Switzerland ..... 04090/88-9

[51] Int. Cl.[5] ..... C01G 3/00

[52] U.S. Cl. ..... 423/566; 75/567; 75/568

[58] Field of Search ..... 75/53, 58; 420/23

[56] References Cited

U.S. PATENT DOCUMENTS 3,998,625 12/1976 Koros ..... 75/58

*Primary Examiner*—Peter D. Rosenberg

*Attorney, Agent, or Firm*—Bachman & LaPointe

[57] ABSTRACT

A process for treating molten cast iron with pure magnesium wherein a granular mixture of magnesium granules admixed with granules of refractory material is flooded with molten iron. By employing granular refractory material of controlled size in the granular mixture, the rate of absorption of magnesium into the iron melt may be effectively controlled so as to optimize magnesium introduction at minimal costs.

9 Claims, No Drawings

PROCESS FOR TREATING MOLTEN IRON WITH MAGNESIUM ADDITIONS

CROSS REFERENCE TO RELATED APPLICATION

This application is a continuation-in-part of U.S. patent application Ser. No. 349,642, filed May 10, 1989, now U.S. Pat. No. 4,897,242.

BACKGROUND OF THE INVENTION

The present invention relates to a process for treating molten iron with pure magnesium and, more particularly, a process for treating molten iron wherein a granular mixture comprising a granular refractory material and granular magnesium is positioned in a ladle and molten iron is fed to the ladle in a controlled manner so as to substantially eliminate the production of eddies.

There are many known processes wherein granules containing magnesium are mixed with other components and then contacted by molten iron. A typical known process is referred to as the "sandwich" process. Thus, it is known for magnesium granules to be mixed with steel turnings or other abrasives and thereafter contacted with molten iron in an open ladle. The reaction of the magnesium with the melt is controlled by the fact that the melt must first fuse the steel turnings or particles in order to establish a controlled availability of the magnesium granules for reaction with the iron melt. The disadvantage associated with such a process is that the melt cools down during the time period of the process. In order to compensate for this cooling, the iron melt must be charged at a very high temperature to the "sandwich" ladle which involves high melting costs and, as a result of the initial high temperature of the iron melt, a poorer yield of magnesium.

In another known process, magnesium granules are mixed with so-called modifiers, for example, calcium carbide, sand, graphite and the like, in order to delay the reaction between the magnesium and the melt in order to achieve controlled availability of magnesium for reaction with the iron melt. In practice, it has been found that this particular process does not always proceed correctly as it is difficult to control the process from proceeding too fast, that is, making magnesium available at a rate higher than desired. As a result, difficulties arise with such a process.

Naturally, it would be highly desirable to develop a process for treating molten iron with pure magnesium wherein the magnesium is exposed to the iron melt in a controlled manner thereby maximizing magnesium absorption while at the same time controlling reaction parameters.

Accordingly, it is the principal object of the present invention to provide a process for treating molten iron with pure magnesium wherein magnesium is introduced into the iron melt in a controlled manner.

It is a further object of the present invention to provide a process as set forth above wherein the reaction proceeds in a controlled manner without the requirement of providing high heat input.

Further objects and advantages of the present invention will appear hereinbelow.

SUMMARY OF THE INVENTION

In order to achieve the foregoing objects, the process of the present invention comprises providing a granular mixture in a ladle wherein the mixture comprises a granular refractory material of controlled size admixed with granular magnesium of controlled size. Molten iron is fed to the ladle in a controlled whirl-free manner so as to avoid the production of significant eddies. The size of the granular refractory material is selected in such a manner that, but for the presence of the granular magnesium material, the granular refractory material would be prevented from rising in the melt due to the interfacial tension of the melt. In accordance with the process of the present invention, the granular magnesium partially vaporizes when in contact with the iron melt, that is, the magnesium in the granular mixture exposed to the melt reacts with the iron melt which results in partial vaporization of the granular magnesium. As a result of the vaporization of the granular magnesium exposed to the melt the surface tension of the iron melt is disturbed which allows for the granular refractory material to rise in the melt. As the granular refractory material rises in the melt, additional magnesium granules become exposed to the iron melt and they too vaporize. As the additional granular magnesium vaporizes, the surface tension is further disturbed so as to allow for more granular refractory material to rise thereby allowing for additional magnesium granules to be exposed to the melt for absorption. This continues until the entire amount of magnesium is absorbed into the iron melt in a controlled manner over a period of time.

By way of the process of the present invention, magnesium is introduced into an iron melt in a controlled whirl-free manner which is superior to that achieved in known prior art processes.

DETAILED DESCRIPTION

The present invention is drawn to a process for treating molten iron with pure magnesium.

In accordance with the process of the present invention, a granular mixture of material is provided in a ladle to which molten iron will be added. In accordance with the particular features of the present invention, the granular material comprises a granular refractory material of controlled size admixed with granular magnesium of controlled size. In order to achieve a controlled absorption of magnesium into an iron melt, the process of the present invention requires that the granular refractory material and the granular magnesium material be of controlled size and, preferably, of a particle size of about between 0.2 to about 5.0 mm. The size of the granular refractory material is chosen in such a manner that, if the granular material were present by itself in a ladle filled with molten iron wherein the iron is fed in a controlled whirl-free manner so as to prohibit the production of eddies, the granular refractory material would not rise in the melt due to the surface tension of the iron melt. Therefore, it is a specific process step of the present invention to feed the iron melt to the ladle containing the granular mixture as described above in a controlled manner so as to prohibit the production of eddies. In addition, the temperature of the molten iron melt is controlled in order to insure that the granular refractory material is free flowing at the temperature of the melt.

In accordance with the present invention, the mixing ratio of the magnesium granules to the refractory material granulars should be in the range of from about 1:1 to about 1:40 and preferably 1:5 to 1:10. By controlling the ratio of magnesium granules to refractory granules, both the amount of magnesium and the rate of magnesium absorption into the iron melt can be controlled.

In accordance with a preferred embodiment of the present invention, mullite is employed as the granular refractory material in the process of the present invention. In addition, the granular magnesium can be coated with ceramic materials in known manner as disclosed in co-pending application Ser. No. 349,642, filed on May 10, 1989 of which the instant application is a continuation-In-part.

In accordance with a further feature of the present invention the granular mixture may be formed as a solid body by incorporating a binder into the granular materials wherein the binder disintegrates upon contact with the molten iron melt.

In accordance with a still further feature of the present invention, the granular mixture may include additional additives selected from the group consisting of silicon carbide, cerium, calcium, barium and mixtures thereof.

The process of the present invention will be described in further detail hereinbelow.

In accordance with the process of the present invention for treating molten iron with pure magnesium, a granular mixture is provided in an open ladle. The granular mixture comprises granular refractory material of controlled size and granular magnesium in the form of pure magnesium of a controlled size. Molten iron is thereafter fed to the ladle containing the granular mixture in a controlled manner so as to prohibit the production of eddies. The granular refractory material is sized in such a manner that, but for the production of eddies and but for the presence of the granular magnesium, the granular refractory material is prevented from rising in the melt due to the interfacial tension of the iron melt. Upon the feeding of the iron melt to the ladle containing the granular mixture of the present invention, the magnesium granules tart to vaporize which disturbs the surface tension of the molten iron melt which allows for the controlled sized granular refractory material to rise in the melt thereby exposing additional magnesium granules. As the additional magnesium granules vaporize, the interfacial surface tension of the iron melt is further disturbed thereby allowing for further refractory granular materials to rise. As the process continues, the magnesium material is absorbed into the iron melt in a controlled manner at a controlled rate. In accordance with a particular feature of the present invention, the granular material is free flowing at the temperature of the molten iron melt. As previously noted, the size of the magnesium granules and the refractory material granules should be between about 0.2 to about 5.0 mm and the mixing ratio of the magnesium granules to refractory granules should be in the range of from about 1:1 to 1:40 and preferably from about 1:5 to about 1:10.

As noted above the magnesium granules partially vaporize because, in spite of the favorable magnesium availability in the form of small granular particles distributed over a large surface, local supersaturation of the iron melt with magnesium still occurs. As is known, molten iron at a temperature of 1450° C. at a ferrostatic pressure of 1 bar can absorb only 0.16% of magnesium. As a result some of the larger granules of magnesium partially vaporize. This particular phenomenom is exploited in the process of the present invention to disturb the interfacial surface tension of the melt and to move the iron melt bath. As a result of disturbing the interfacial surface tension of the melt the granular refractory material is no longer held at the bottom of the vessel by the melt in the activity region of the vaporizing magnesium granules and, therefore, the refractory material can float upward. As a result of the upward flotation of the refractory granular material, further magnesium granules become exposed to the melt. As a result, a controlled layered float-up of the refractory material is achieved as a result of it being free-floating at the temperature of the melt and the release of magnesium granules for reaction with the melt is controlled. As noted above mullite can be used as a granular refractory material and is preferred; however, additional refractory material such as quartz sand, zirconium sand, chromite sand and the like can also be used.

As noted above, in a further embodiment of the process of the present invention, a solid body of granular refractory material mixed with magnesium granules and held together by a binder may be substituted for the loose granular mixture discussed above. The solid body, under the action of the high temperature of the iron melt, gradually disintegrates thereby again resulting in a controlled release of magnesium granules for reaction with the iron melt.

In accordance with a further feature of the present invention, it has been found that the interfacial surface tension of the melt can be more extensively disturbed if the magnesium granules are encased in a ceramic layer. The foregoing is true particularly in the case of the larger sized magnesium granules. Under the action of high temperature, the magnesium granules melt and their ceramic casings burst when a certain pressure is reached. As a result of the bursting of the ceramic casings, the interfacial surface tension of the iron melt is disturbed in a relatively wide region and the action of the magnesium is enhanced due to it "spraying" into the melt.

A particular advantage of the process of the present invention results in the fact that the iron melt is cooled down to a lesser extent by the granular refractory materials employed in the instant process when compared to the metal components such as steel turnings and abrasives as noted above with regard to known prior art processes. In addition, as a result of the process of the present invention, no unwanted metals are introduced into the melt nor is the chemical analysis of the final product effected as would be the case, for example, with the introduction of a mixture based on graphite. In the instant process, it is advantageous to cover the mixture of the granular refractory material and magnesium granules with a thin layer of, for example, an abrasive in order to delay the time for reaction while the sandwich ladle is being charged with molten iron.

The process of the present invention is also usable with the so-called rotor ladle. In such a case a pocket of the rotor ladle is filled with the granular mixture and closed off by, for example, a piece of sheet metal. After the rotor ladle has been set into rotation, the molten cast iron is poured in and floods the pocket containing the granular mixture. The reaction of the magnesium with the melt in accordance with the process of the present invention starts once the metal sheet has fused. The centrifugal force of the rotating ladle ensures a clean melt.

In order to increase local solubility of magnesium into the iron melt, it has been found to be advantageous to admix with the granular magnesium and granular refractory material a granular addition of silicon carbide. In addition, silicon granules could be used in order to suppress the interfering effect of trace elements such as Bi, Sn, Sb and others. The effect of magnesium can be further enhanced by additions of small quantities of calcium and barium.

A mixture of magnesium granules and granular refractory material according to the process of the present invention is also suitable for all processes in which expensive magnesium master alloys are used. Instead of the expensive magnesium master alloys, the cheap granular mixture described above can, for example, be metered into the open pocket of a tilting ladle, rotary ladle or the like.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for treating molten iron with magnesium comprising:

introducing a granular mixture into a holding vessel, said granular material comprising granular refractory material of controlled size and granular magnesium of controlled size wherein the granular size of said refractory material is controlled so that, but for the presence of said granular magnesium, said granular refractory material is prevented from rising in the melt due to its controlled size and the interfacial surface tension of the melt; and feeding molten iron to said vessel in a controlled whirl-free manner whereby no significant eddies are produced whereby the granular magnesium exposed to said molten iron partially vaporizes and disturbs said interfacial surface tension of the melt thereby allowing said granular refractory material to rise in said melt so as to expose additional granular magnesium to said melt which in turn vaporizes thereby allowing for the controlled introduction of magnesium into said iron melt.

2. A process according to claim 1 including controlling the temperature of said molten iron such that said granular refractory material is free flowing.

3. A process according to claim 1 including controlling the size of said granular refractory material and said granular magnesium to between 0.2 to 5.0 mm.

4. A process according to claim 1 including providing a granular mixture wherein the mixing ratio of granular magnesium to granular refractory material is from 1:1 to 1:40.

5. A process according to claim 1 including providing a granular mixture wherein the mixing ratio of granular magnesium to granular refractory material is from 1:5 to 1:10.

6. A process according to claim 1 including providing mullite as the granular refractory material.

7. A process according to claim 1 including the steps of coating said granular magnesium with a ceramic material.

8. A process according to claim 2 including adding a binder to the mixture of granular magnesium and granular refractory material so as to form a solid body wherein the binder is dissolvable at the temperature of the molten iron.

9. A process according to claim 1 including adding an additive selected from the group consisting of silicon carbide, cerium, calcium, barium and mixtures thereof in a desired amount in order to increase solubility of said magnesium in the iron melt.

* * * * *